US009299319B2

(12) United States Patent
Han

(10) Patent No.: US 9,299,319 B2
(45) Date of Patent: Mar. 29, 2016

(54) DISPLAY DEVICE FOR DISPLAYING AN IMAGE WITH ACCURATE LUMINANCE AND METHOD FOR DRIVING THE SAME

(71) Applicant: Sang-Myeon Han, Yongin (KR)

(72) Inventor: Sang-Myeon Han, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 344 days.

(21) Appl. No.: 13/869,073

(22) Filed: Apr. 24, 2013

(65) Prior Publication Data

US 2014/0139566 A1 May 22, 2014

(30) Foreign Application Priority Data

Nov. 20, 2012 (KR) ..... 10-2012-0131914

(51) Int. Cl.

| | |
|---|---|
| ***G09G 3/30*** | (2006.01) |
| ***G09G 5/10*** | (2006.01) |
| ***G09G 3/00*** | (2006.01) |
| ***G09G 3/20*** | (2006.01) |
| *G09G 3/10* | (2006.01) |
| *G09G 3/32* | (2006.01) |

(52) U.S. Cl.

CPC ..... *G09G 5/10* (2013.01); *G09G 3/003* (2013.01); *G09G 3/2022* (2013.01); *G09G 3/3233* (2013.01); *G09G 3/325* (2013.01); *G09G 2300/0814* (2013.01); *G09G 2300/0842* (2013.01); *G09G 2300/0852* (2013.01); *G09G 2310/061* (2013.01); *G09G 2310/08* (2013.01)

(58) Field of Classification Search

CPC ..... G09G 3/325
USPC ..... 345/76; 315/169.3
See application file for complete search history.

(56) References Cited

U.S. PATENT DOCUMENTS

| | | | | |
|---|---|---|---|---|
| 2008/0170011 | A1* | 7/2008 | Kohno et al. | 345/77 |
| 2009/0015575 | A1* | 1/2009 | Le Roy et al. | 345/209 |
| 2011/0025671 | A1* | 2/2011 | Lee | 345/211 |
| 2012/0007848 | A1* | 1/2012 | Han et al. | 345/212 |
| 2012/0062538 | A1* | 3/2012 | Koyama | 345/211 |
| 2012/0235972 | A1* | 9/2012 | Liu et al. | 345/211 |

FOREIGN PATENT DOCUMENTS

| | | | |
|---|---|---|---|
| KR | 10-2009-0131042 | A | 12/2009 |
| KR | 10-2011-0013693 | A | 2/2011 |
| KR | 10-1073281 | B1 | 10/2011 |
| KR | 10-2012-0043301 | A | 5/2012 |

* cited by examiner

*Primary Examiner* — Adam J Snyder
(74) *Attorney, Agent, or Firm* — Lee & Morse, P.C.

(57) ABSTRACT

A display device includes a display panel, the display panel including a plurality of pixels that, during one frame, receive a first voltage transmitted through a data line and a second voltage having a higher level than the first voltage, receive and store a third voltage of a first image data signal corresponding to a current frame, and emit light by driving current for a fourth voltage corresponding to a second image data signal corresponding to a previous frame, wherein, of one frame, a first period for storing the third voltage and a second period for emitting light by the driving current for the fourth voltage overlap each other.

29 Claims, 8 Drawing Sheets

DISPLAY DEVICE FOR DISPLAYING AN IMAGE WITH ACCURATE LUMINANCE AND METHOD FOR DRIVING THE SAME

CROSS-REFERENCE TO RELATED APPLICATION

This application claims priority to and the benefit of Korean Patent Application No. 10-2012-0131914 filed in the Korean Intellectual Property Office on Nov. 20, 2012, the entire contents of which are incorporated herein by reference.

BACKGROUND

1. Field

Embodiments relate to a display device and a method for driving the same.

2. Description of the Related Art

In recent years, display panels become larger in size and more lightweight, and display devices require high integration and high precision to realize a 3-dimensional stereoscopic image. A method of stably driving a frame may display an accurate and sharp image.

The above information disclosed in this Background section is only for enhancement of understanding of the background of the invention and therefore it may contain information that does not form the prior art that is already known in this country to a person of ordinary skill in the art.

SUMMARY

Embodiments are directed to a display device, including a display panel, the display panel including a plurality of pixels that, during one frame, receive a first voltage transmitted through a data line and a second voltage having a higher level than the first voltage, receive and store a third voltage of a first image data signal corresponding to a current frame, and emit light by driving current for a fourth voltage corresponding to a second image data signal corresponding to a previous frame, wherein, of one frame, a first period for storing the third voltage and a second period for emitting light by the driving current for the fourth voltage overlap each other.

The first image data signal may be a first viewpoint image data signal or a second viewpoint image data signal corresponding to the current frame, the second image data signal may be a first viewpoint image data signal or a second viewpoint image data signal corresponding to the previous frame, and viewpoints of the first image data signal and the second image data signal may be different.

One frame may include a reset period for transmitting the first voltage to one end of a compensation capacitor connected to a gate electrode of a driving transistor through the data line, an initialization period for applying a first power source voltage of a first level from a power supply unit and setting a drain electrode voltage of the driving transistor to the first level, a compensation period for simultaneously compensating for a threshold voltage of the driving transistor of each of the plurality of pixels, a data transmission period for transmitting the fourth voltage to one end of the compensation capacitor, a data writing period for storing the third voltage in response to a scan signal sequentially transmitted to the plurality of pixels, and a light emission period for allowing an organic light emitting diode of each of the plurality of pixels to simultaneously emit light by the driving current for the fourth voltage transmitted in the data transmission period, the light emission period overlapping the data writing period.

The data writing period may be equal to or shorter than the light emission period.

A duration of the reset period during one frame may be determined depending on material characteristics of the driving transistor.

All of the pixels may not emit light during the reset period, the initialization period, the compensation period, and the data transmission period.

The first voltage may have a gate-on voltage level for turning on elements of each pixel.

The second voltage may be set to a voltage value between lowest and highest values of a data voltage of an image data signal.

An amount of driving current may be determined by taking into account an amount of voltage change according to a capacitance ratio of a storage element connected to one end of a compensation capacitor connected to a gate electrode of a driving transistor of the pixel, with respect to the fourth voltage.

Each of the plurality of pixels may include an organic light emitting diode, a first transistor that transmits the driving current to the organic light emitting diode, a second transistor that transmits the fourth voltage to a first contact point connected to one end of a compensation capacitor connected to a gate electrode of the first transistor, a third transistor that is provided between the gate electrode and a drain electrode of the first transistor and diode-connects the gate electrode and drain electrode of the first transistor, a fourth transistor that is provided between the data line and the first contact point and transmits the first voltage and the second voltage to the first contact point, a fifth transistor that transmits a predetermined reference voltage applied from a power supply line to a second contact point connected to one electrode of the second transistor, in response to a corresponding one of a plurality of scan signals, a storage capacitor, electrodes of which are connected between a source electrode of the first transistor and the first contact point, and which stores a voltage corresponding to a potential difference between the storage capacitor electrodes, a compensation capacitor, electrodes of which are connected between the gate electrode of the first transistor and the first contact point, and which stores a voltage corresponding to a potential difference between the compensation capacitor electrodes, and a sustain capacitor, electrodes of which are connected between the data line and the second contact point, and which stores a voltage corresponding to a potential difference between the sustain capacitor electrodes.

The sustain capacitor may store the third voltage until a data transmission period of a next frame, and stores the fourth voltage until a data transmission period of the current frame.

A first power source voltage applied to the source electrode of the first transistor may be transmitted at low level during a reset period and an initialization period, a second power source voltage applied to the drain electrode of the first transistor may be transmitted at low level during the initialization period and a light emission period, the plurality of scan signals may be sequentially transmitted at a gate-on voltage level for each pixel line during a data writing period, a first control signal transmitted to gate electrodes of the third transistor and fourth transistor may be transmitted at a gate-on voltage level during the reset period and a compensation period, and is changed from the gate-on voltage level to a gate-off voltage level and transmitted during the initialization period, and a second control signal transmitted to the gate electrode of the second transistor may be transmitted at a gate-on voltage level during a data transmission period.

The first voltage may be applied through a data line connected to a source electrode of the fourth transistor during a reset period while the third transistor and the fourth transistor are in a turned-on state, and the second voltage may be applied through the data line during an initialization period and a compensation period while the third transistor and the fourth transistor are in the turned-on state.

Each of the plurality of pixels may receive the first voltage through a power supply line and the second voltage through the data line, during one frame.

One frame may include a reset period for transmitting the first voltage to one end of a compensation capacitor connected to a gate electrode of a driving transistor through the power supply line, an initialization period for applying a first power source voltage of a first level from a power supply unit and setting a drain electrode voltage of the driving transistor of the pixel to the first level, a compensation period for simultaneously compensating for a threshold voltage of the driving transistor of each of the plurality of pixels, a data transmission period for transmitting a fourth voltage of a second image data signal corresponding to the previous frame to one end of the compensation capacitor, a data writing period for storing the third voltage of the first image data signal corresponding to the current frame in response to a scan signal sequentially transmitted to the plurality of pixels, and a light emission period for allowing an organic light emitting diode of each of the plurality of pixels to simultaneously emit light by the driving current for the fourth voltage transmitted in the data transmission period, the light emission period overlapping the data writing period.

The data writing period may be equal to or shorter than the light emission period.

Each of the plurality of pixels may include an organic light emitting diode, a first transistor that transmits the driving current to the organic light emitting diode, a second transistor that is provided between the data line and a third contact point and transmits the second voltage and a data voltage of the first image data signal corresponding to the current frame to the third contact point through the data line in response to a corresponding one of a plurality of scan signals, a third transistor that is provided between a gate electrode and a drain electrode of the first transistor and diode-connects the gate electrode and drain electrode of the first transistor, a fourth transistor that is provided between a fourth contact point and a fifth contact point and transmits a voltage stored in response to the second image data signal corresponding to the previous frame to the fifth contact point, a fifth transistor that is provided between the power supply line and the fourth contact point and transmits the first voltage applied through the power supply line to the fourth contact, a storage capacitor, electrodes of which are connected between a source electrode of the first transistor and the fifth contact point, and which stores a voltage corresponding to a potential difference between the storage capacitor electrodes, a compensation capacitor, electrodes of which are connected between the gate electrode of the first transistor and the fifth contact point, and which stores a voltage corresponding to a potential difference between the compensation capacitor electrodes, and a sustain capacitor, electrodes of which are connected between the third contact point and the fourth contact point, and which stores a voltage corresponding to a potential difference between the sustain capacitor electrodes.

The sustain capacitor may maintain a voltage value stored for the data voltage of the first image data signal until a data transmission period of a next frame, and maintain a voltage value stored for the second image data signal until a data transmission period of the current frame.

A first power source voltage applied to the source electrode of the first transistor may be transmitted at a low level during an initialization period, a second power source voltage applied to the drain electrode of the first transistor may be transmitted at a low level during a light emission period, the plurality of scan signals may be simultaneously transmitted at a gate-on voltage level to the gate electrodes of the second transistors of the plurality of pixels during a data transmission period, and sequentially transmitted at the gate-on voltage level to gate electrodes of the second transistors of each pixel line during a data writing period, a first control signal transmitted to a gate electrode of the third transistor may be transmitted at a gate-on voltage level during a compensation period, a second control signal transmitted to a gate electrode of the fourth transistor may be transmitted at a gate-on voltage level during a reset period, the compensation period, and the data transmission period, and a third control signal transmitted to a gate electrode of the fifth transistor may be transmitted at a gate-on voltage level during a remaining period other than the data transmission period.

The first voltage may be applied through the power supply line during a reset period while the fifth transistor is in a turned-on state, and the second voltage may be applied through the data line during a data transmission period in which the plurality of scan signals are simultaneously transmitted at a low level to turn on the second transistor.

The display device may further include a scan driver that generates and transmits a plurality of scan signals for activating driving of the plurality of pixels, a data driver that transmits the first voltage, the second voltage, or a data voltage of an image data signal corresponding to the plurality of pixels through the data line, a power supply controller that controls a driving power source voltage supplied to the plurality of pixels and a reference voltage, a compensation control signal unit that generates and transmits a first control signal and a second control signal to control the transistors included in each of the plurality of pixels depending on periods included in one frame, and a timing controller that processes an external image signal to generate and transmit an image data signal corresponding to a frame to the data driver, and controls a driving of the scan driver, the data driver, the power supply controller, and the compensation control signal unit.

The data driver may transmit the second data voltage or a data voltage of an image data signal corresponding to the plurality of pixels, and the compensation control signal unit may generate and transmit a third control signal to allow the power supply controller to apply the reference voltage.

Embodiments are also directed to a method for driving a display device that includes a display panel, the display panel including a plurality of pixels that receive a first voltage transmitted through a data line and a second voltage having a higher level than the first voltage, receive and store a third voltage of a first image data signal corresponding to a current frame, and emit light by driving current for a fourth voltage corresponding to a second image data signal corresponding to a previous frame, the method including a reset step that includes transmitting the first voltage to one end of a compensation capacitor connected to a gate electrode of a driving transistor through the data line, an initialization step that includes applying a first power source voltage of a first level from a power supply unit and setting a drain electrode voltage of the driving transistor to the first level, a compensation step that includes simultaneously compensating for a threshold voltage of the driving transistor of each of the plurality of pixels, a data transmission step that includes transmitting the fourth voltage to one end of the compensation capacitor, a data writing step that includes storing the third voltage in response to a scan signal sequentially transmitted to the plurality of pixels, and a light emission step that includes allowing an organic light emitting diode of each of the plurality of pixels to simultaneously emit light by the driving current for the fourth voltage transmitted in the data transmission step, the light emission step overlapping the data writing step.

A period in which the data writing step is performed may be equal to or shorter than a period in which the light emission step is performed.

The first voltage may have a gate-on voltage level for turning on elements of each pixel.

The second voltage may be set to a voltage value between lowest and highest values of a data voltage of an image data signal.

An amount of driving current may be determined by taking into account an amount of voltage change according to a capacitance ratio of a storage element connected to one end of the compensation capacitor connected to the gate electrode of the driving transistor, with respect to the fourth voltage.

All of the pixels may not emit light during the reset step, the initialization step, the compensation step, and the data transmission step.

The first image data signal may be a first viewpoint image data signal or a second viewpoint image data signal corresponding to the current frame, the second image data signal may be a first viewpoint image data signal or a second viewpoint image data signal corresponding to the previous frame, and viewpoints of the first image data signal and the second image data signal may be different.

Each of the plurality of pixels may receive the first voltage through a power supply line in the reset step and receive the second voltage through the data line in the data transmission step.

BRIEF DESCRIPTION OF THE DRAWINGS

Features will become apparent to those of skill in the art by describing in detail example embodiments with reference to the attached drawings in which.

DETAILED DESCRIPTION

Figure 1:
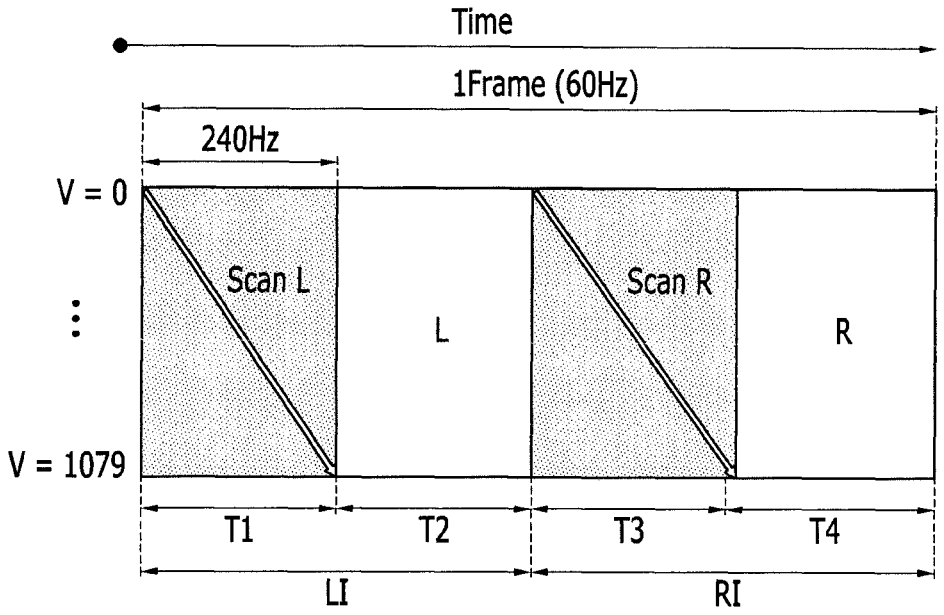
FIG. 1 is a view showing a driving scheme of a general display device.

Example embodiments will now be described more fully hereinafter with reference to the accompanying drawings; however, they may be embodied in different for ins and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "on" another element, it can be directly on the other element, or one or more intervening elements may also be present. It will also be understood that when an element is referred to as being "under" another element, it can be directly under, or one or more intervening elements may also be present. It will also be understood that when an element is referred to as being "between" two elements, it can be the only element between the two elements, or one or more intervening elements may also be present. Like reference numerals refer to like elements throughout.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a view showing a driving scheme of a general display device.

The driving scheme of the general display device of FIG. 1 shows an example of a variety of driving schemes of a general display device. Particularly, FIG. 1 depicts a driving scheme for realizing a 3-dimensional stereoscopic image, in which one frame (60 Hz) is driven in a first viewpoint image interval LI and a second viewpoint image interval RI.

The first viewpoint is a left(right)-eye viewpoint, and the second viewpoint is a right(left)-eye viewpoint.

An image data signal is transmitted in first and second viewpoints during one frame to display the same object so that the user can feel a 3-dimensional stereoscopic effect.

Therefore, the first viewpoint image interval LI and the second viewpoint image interval RI include scan periods scanL and scan R and light emission periods L and R so as to drive all pixels of the display panel and display images for the respective viewpoints.

That is, the first viewpoint image interval LI includes a first viewpoint scan period T1 for sequentially activating each pixel to write a first viewpoint image data signal on all the pixels of the display panel and a first viewpoint light emission period T2 for displaying an image in response to the first viewpoint image data signal. Likewise, the second viewpoint image interval RI includes a second viewpoint scan period T4 for sequentially activating each pixel to write a second viewpoint image data signal on all the pixels of the display panel and a second viewpoint light emission period T4 for displaying an image in response to the second viewpoint image data signal.

According to the driving scheme of the general display device of FIG. 1, stereoscopic image display includes at least scan and light emission periods for displaying a first viewpoint image and scan and light emission periods for displaying a second viewpoint image during one frame (60 Hz). Thus, the first and second viewpoint images each have to be processed at ¼ frame rate (240 Hz).

Once scan periods for all the pixels of the display panel and light emission periods corresponding to the image data signals are separately provided as shown in FIG. 1, this may offer advantages in reducing motion blur and realizing a 3-dimensional stereoscopic image. However, the light emission periods are limited to less than half a frame, making it difficult to display an image with accurate luminance. Accordingly, even in the case of the non-3D stereoscopic image driving, since a light emitting ratio is not increased to maximize the light emitting luminance in order to ensure average luminance, driving voltage may increase and power consumption may increase. In addition, current may also be increased during emitting of the light and as a result non-uniformity of luminance may be relatively increased due to an IR Drop.

As described herein, embodiments may provide a method of driving method a display device to emit light by writing data after sufficiently resetting a pixel circuit of the entire display panel and compensating threshold voltage of a transistor when the image is expressed regardless of driving of a general image or driving of the 3D stereoscopic image.

Figure 2:
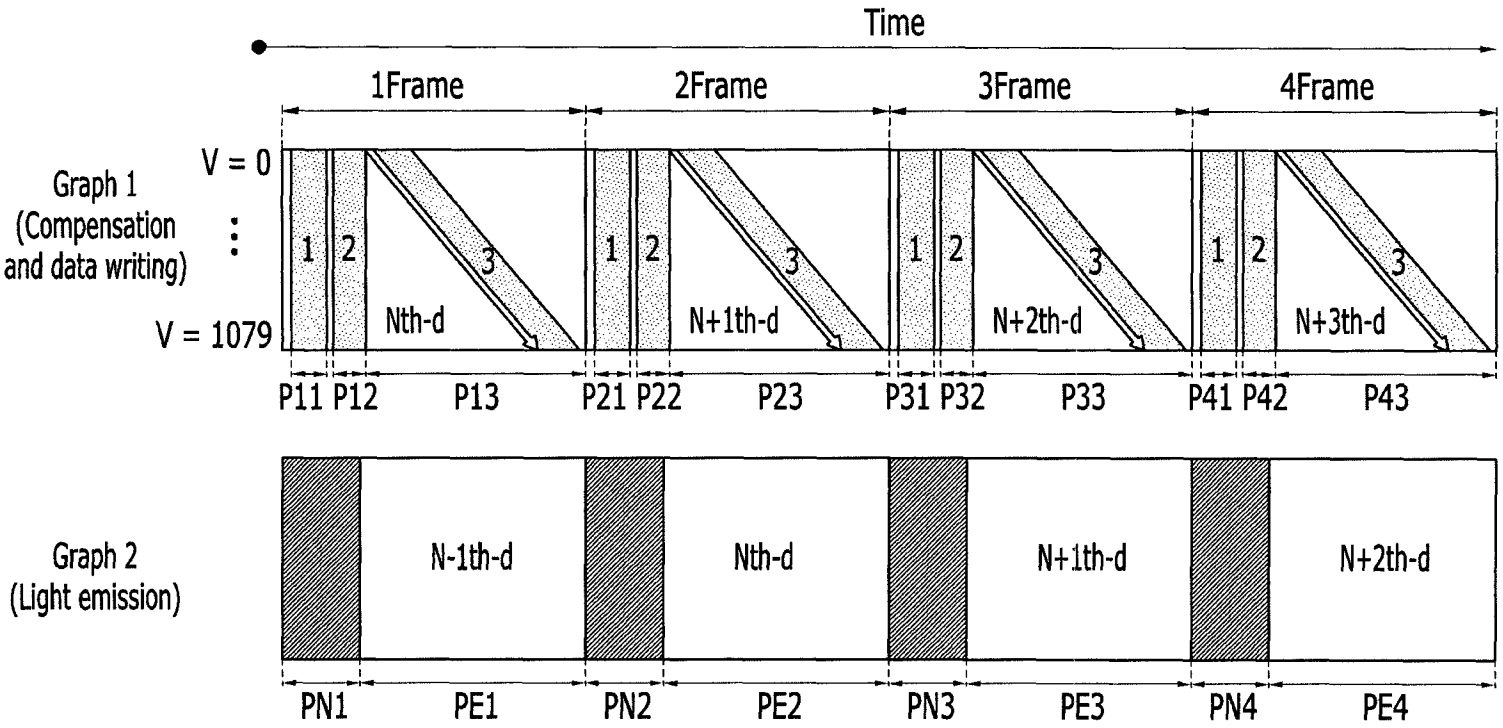
FIG. 2 is a view showing a driving scheme of a display device according to an example embodiment.

FIG. 2 is a view showing a driving scheme of a display device according to an example embodiment.

The driving scheme of FIG. 2 shows a method for realizing a typical 2-dimensional image.

FIG. 2 depicts Graph 1 showing a process of compensating for a threshold voltage of a driving transistor of each pixel included in the display panel and writing data and Graph 2 showing an emission process of the display panel, both of which are presented over the same period of time.

The display panel according to the example embodiment of FIG. 2 is illustrated as including, but not limited to, a total of 1080 pixel lines.

In FIG. 2, each frame is sequentially driven over time, starting from a first frame 1Frame.

In the driving scheme of the display device according to the present embodiment, as shown in FIG. 2, each of a plurality of frames includes a reset period 1, a threshold voltage compensation period 2, a data writing period 3, and a light emission period 4. The data writing period 3 and the light emission period 4 occur simultaneously.

Firstly, all the pixel circuits of the display panel are simultaneously reset in a reset period P11 of the first frame 1Frame. Resetting of the pixel circuits refer to setting a voltage corresponding to a data signal input into each pixel circuit in the previous frame to a predetermined reference voltage (reset voltage). That is, a data voltage corresponding to each data signal of the previous frame, which is charged in storage capacitors of the pixel circuits, is charged or discharged to maintain a predetermined reset voltage.

Next, the threshold voltage of each of the driving transistors of all the pixel circuits of the display panel is simultaneously compensated for during a threshold voltage compensation period P12 of 1Frame. The driving transistors of the pixel circuits of the display panel vary in threshold voltage depending on factors of the manufacturing process of the display panel or material characteristics of the display panel. Achieving accurate luminance for the pixels may be made more difficult by to threshold voltage variations. Accordingly, in the threshold voltage compensation period P12, the threshold voltage of the driving transistors of all the pixels is simultaneously compensated for in order to reduce luminance non-uniformity caused by threshold voltage variations of the driving transistors of the pixels.

According to another example embodiment, an initialization period (not shown) may be further included between the reset period P11 and the threshold voltage compensation period P12. The initialization period is a period for applying an initialization voltage to the storage capacitor of each pixel in order to ensure resetting of the data voltage of the previous frame applied to each pixel of the display panel.

The reset period P11 and threshold voltage compensation period P12 of the first frame 1Frame correspond to a non-light emission period PN1 during which all the pixels do not emit light.

After all the pixel circuits of the display panel are reset during the reset period, and the threshold voltage of all the driving transistors of the display panel are compensated for during the threshold voltage compensation period, an image data signal of a frame subsequent to the current frame is sequentially transmitted to each line of the pixels of the display panel during the data writing period. That is, an image data signal Nth-d corresponding to a second frame 2Frame, the next frame, is sequentially written during a data writing period P13 of the first 1Frame.

After the image data signal Nth-d corresponding to the second frame 2Frame is written on each pixel during the data writing period P13 of the first frame 1Frame, all the pixels of the display panel simultaneously display an image corresponding to the image data signal in a light emission period PE2 of the second frame 2Frame.

Simultaneously with the sequential writing of the image data signal Nth-d corresponding to the second frame 2Frame to each pixel of the display panel during the data writing period P13 of the first frame 1Frame, all the pixels of the display panel emit light only during a light emission period PE1 of the first frame 1Frame in response to the image data signal N−1th-d written in the previous frame.

During the second frame 2Frame subsequent to the first frame, a reset period P21, a threshold voltage compensation period P22, and a data writing period P23 continuously occur in a likewise manner, the reset period P21 for resetting a data voltage in response to the image data signal Nth-d written in the first frame, the threshold voltage compensation period P22 for compensating for a threshold voltage of the driving transistor of each pixel of the display panel, and the data writing period P23 for sequentially writing an image data signal N+1th-d corresponding to the second frame 2Frame on each pixel of the display panel.

According to a method for driving a display device according to an example embodiment, data writing and emission are separately performed for a predetermined frame. The data writing is sequentially performed for each line of the pixels, and the emission occurs simultaneously in the entire pixels.

In other words, an operation for sequentially writing an image data signal of the current frame during one frame and an operation for simultaneously emitting light in response to the image signal written in the previous frame are not divided, but occur simultaneously for all the pixels of the display panel during one frame. Accordingly, a data writing period can be set to be almost equal in length to one frame period, and the starting and ending points of a light emission period can be freely set within one frame, regardless of the data writing period.

Figure 3:
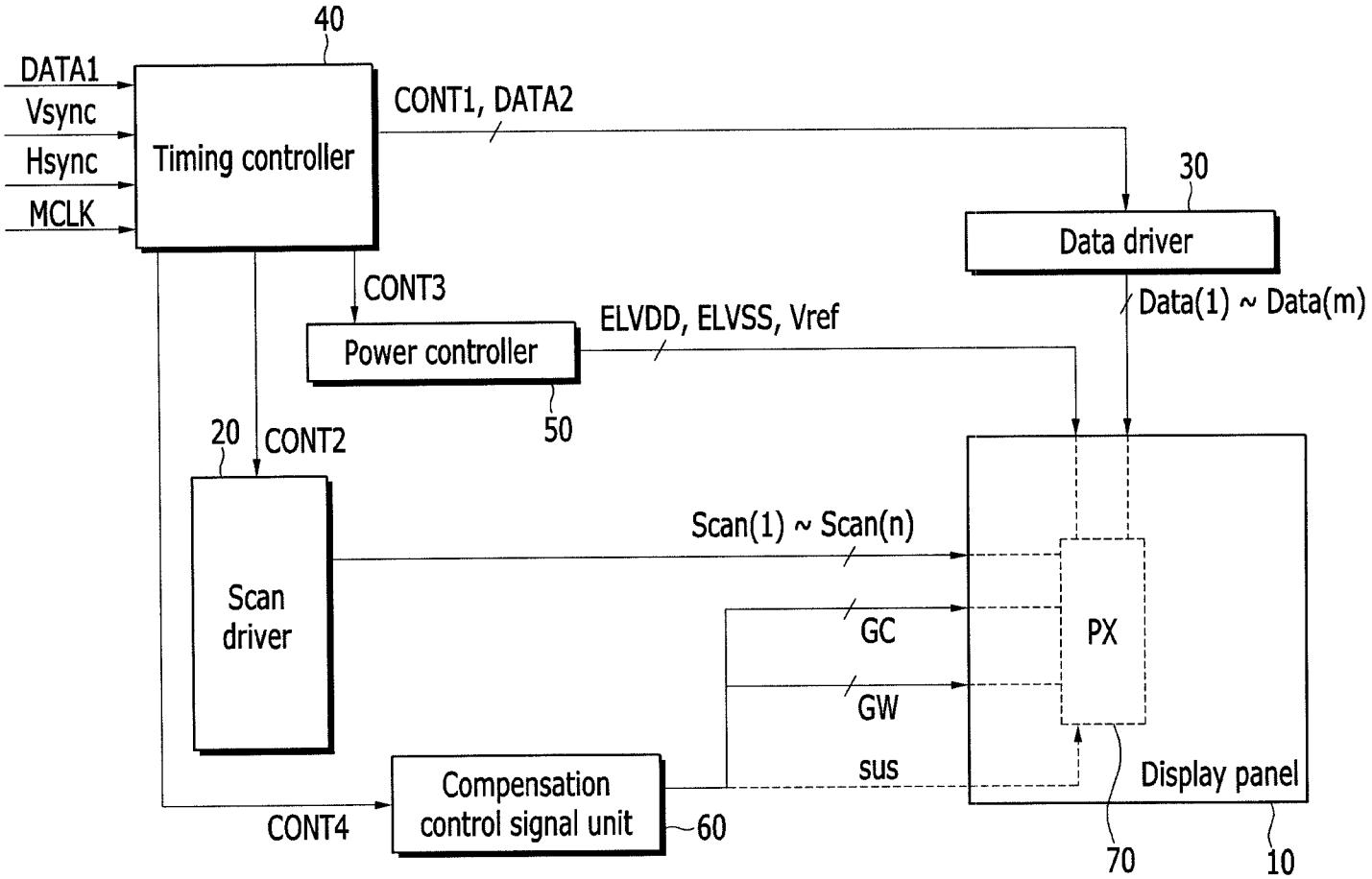
FIG. 3 is a block diagram showing a display device according to an example embodiment.

FIG. 3 is a block diagram showing the configuration of a display device to which the driving method according to an embodiment may be applied.

The display device according to the example embodiment of FIG. 3 includes a display panel 10, scan driver 20, a data driver 30, a timing controller 40, a power supply controller 50, and a compensation control unit 60.

The display panel 10 includes a plurality of pixels 70 which display an image by emitting light in response to an image data signal DATA2 corresponding to an external image signal DATA1. Each pixel 70 is connected to a corresponding one of a plurality of data lines for transmitting a plurality of data signals data(1)-data(n) and a corresponding scan one of a plurality of scan lines for transmitting a plurality of scan signals scan(1)-scan(n). The plurality of data signals data(1)-data(n) are image data signals which correspond to the respective pixels and generated by performing an image processing procedure, such as luminance correction, on the external image signal. The plurality of scan signal scan(1)-scan(n) are signals which respectively activate the plurality of pixels to cause the plurality of pixels included in the display panel to display an image in response to their corresponding data signals.

The pixel 70 is connected to a plurality of power supply lines for transmitting driving power source voltages ELVDD and ELVDSS and a reference voltage Vref.

Also, the pixel 70 is connected to a corresponding one of a plurality of first control signal lines for transmitting a plurality of first control signals GC and a corresponding one of a plurality of second control signals for transmitting a plurality of second control signals GW. According to another example embodiment, the pixel 70 may be connected to a corresponding one of a plurality of third control signal lines for transmitting a plurality of third control signals sus.

The plurality of first control signals GC are control signals which are involved in a process for resetting all the pixels, an initialization process, and a process for compensating for a threshold voltage of the driving transistors of all the pixels. Specifically, the plurality of first controls signals GC may be used to apply a predetermined reset voltage to gate electrodes of the driving transistors through the data lines of the entire pixels included in the display panel. Moreover, the voltage applied to the driving transistor of each pixel during the previous frame can be initialized by transmitting the driving power source voltages ELVDD and ELVSS of the entire pixels after adjusting their levels, when the pulse voltage of the plurality of first control signals GC is controlled. Further, the plurality of first controls signals GC are able to compensate for the threshold voltage of the driving transistors in order to reduce luminance non-uniformity caused by threshold voltage variations of the driving transistors of all the pixels included in the display panel.

The plurality of second control signals GW are signals which are involved in the transmission of data to all the pixels of the display panel and control the operation of each pixel.

In a method for driving a display device according to another example embodiment, the plurality of third control lines are connected to all the pixels of the display panel 10 to control the driving of the pixels by transmitting the corresponding third control signals sus. The plurality of third control signals sus applied through the plurality of third control lines are control signals which are involved in a process for resetting all the pixels, an initialization process, and a process for compensating for a threshold voltage of the driving transistors of all the pixels. They may be involved in an initialization period and a process for writing a data voltage to each pixel in response to an image data signal and control the operation of each pixel.

The first control signals GC, the second control signals GW, the third control signals sus, the level adjustment of the driving power source voltages ELVDD and ELVSS and reference voltage Vref, and the transmission process of the scan signals and the data signals will be described in detail with reference to the following drawings associated with the structure and driving procedure of pixels according to an example embodiment.

The scan driver 2 generates a plurality of scan signals scan(1)-scan(n) in response to a scan control signal CONT2 and transmit them to the plurality of scan lines connected to the display panel. The scan control signal CONT2 is used to sequentially transmit corresponding scan signals to each line of the plurality of pixels included in the display panel during a data writing period 3 of FIG. 2 of the driving period according to the method for driving the display device of the present invention.

In response to a data control signal CONT1, the data driver 30 transmits an image data signal DATA2 corresponding to an external image signal DATA1 to each of the plurality of pixels of the display panel through the plurality of data signals Data(1)-Data(m). The data control signal CONT1 is used to sequentially transmit corresponding image data signals to each line of the plurality of pixels activated by the scan signals during a data writing period 3 of FIG. 2 of the driving period according to the method for driving the display device of the present invention. Then, each of the plurality of pixels activated by the scan signals stores a data voltage in response to a corresponding image data signal, thereby writing data thereon.

Under control of the data control signal CONT1, the data driver 30 according to an example embodiment may simultaneously transmit a predetermined voltage to each of the plurality of pixels before transmitting a data voltage in response to an image data signal.

The predetermined voltage may be set to a different voltage value (reset voltage, sustain voltage, etc.) depending on an embodiment of the driving method of the display device.

Specifically, the data driver 30 may transmit a reset voltage having a predetermined low level during a reset period for resetting the voltage written in the driving transistor of each pixel. Moreover, the data driver 30 may transmit a sustain voltage having a predetermined level through a corresponding data line during an initialization period for setting the gate, source, and drain electrodes of the driving transistor of each pixel. The value of the sustain voltage has a higher level than the value of the reset voltage, and may be set to a voltage value within the range of data voltages of image data signals.

In response to a power supply control signal CONT3, the power supply controller 50 supplies a driving power source voltage for driving each pixel and a predetermined reference voltage Vref for performing a stable operation in association with the driving procedure of each pixel, through a power supply line connected to each of the plurality of pixels of the display panel.

The predetermined reference voltage Vref may be fixedly applied to one electrode of the sustain capacitor Chold of each pixel, thus allowing each pixel to maintain a corresponding data voltage in response to an image data signal.

The driving power source voltage for driving each pixel includes a first power source voltage ELVDD, which is a predetermined high-level voltage, and a second power source voltage ELVSS, which is a predetermined low-level voltage.

The power source control signal CONT3 is used to allow the power supply controller 50 to adjust the voltage levels of the first power source voltage ELVDD, second power source voltage ELVSS, and reference voltage Vref differently depending on each driving procedure and transmit these voltages to the entire pixels. That is, the power supply controller 50 determines the levels of the first power source voltage ELVDD, second power source voltage ELVSS, and reference voltage Vref and supplies them to the power supply lines, in response to the power control signal CONT3 in accordance with a reset period 1, a threshold voltage compensation period 2, a data writing period 3, and a light emission period 4 of the driving procedure according to one example embodiment.

In a driving procedure according to another example embodiment, even when an initialization period for initializing the voltage of each electrode of a driving transistor is included between the reset period 1 and the threshold voltage compensation period 2, the power supply controller 50 may deter mine the levels of the first power source voltage ELVDD, second power source voltage ELVSS, and reference voltage Vref and supply these voltages to the power supply lines.

In a driving procedure according to still another example embodiment, even when a data transmission period for transmitting a data voltage of an image data signal of the previous frame for light emission is further included between the threshold voltage compensation period 2 and the light emission period 4 (or data writing period 3 equal in length to the light emission period), the power supply controller 50 may determine the levels of the first power source voltage ELVDD, second power source voltage ELVSS, and reference voltage Vref and supply these voltages to the power supply lines.

The compensation control signal unit 60 generates a plurality of first control signals GC and a plurality of second control signals GW and transmits to the plurality of pixels of the display panel in response to a compensation control signal CONT4. In another example embodiment, a plurality of third control signals sus may be generated and transmitted.

Specifically, the compensation control signal CONT4 may include a first compensation control signal for determining the pulse voltage level of the plurality of first control signals GC, a second compensation control signal for determining the pulse voltage level of the plurality of second control signals GW, and a third compensation control signal for determining the pulse voltage level of the plurality of third control signals sus, so as to correspond to a driving period of the driving method.

The timing controller 40 generates a corresponding image data signal DATA2 from an external image signal DATA1, and controls the functions and operations of the components of the display device.

In detail, the timing controller 40 classifies the image signal DATA1 into a frame unit according to a vertical synchronization signal Vsync and classifies the image signal DATA1 into a pixel line (scan line) unit according to a horizontal synchronization signal Hsync and processes the external image signal DATA1 to generate an image data signal DATA2.

The image data signal DATA2 is transmitted to the data driver 30, along with the data control signal CONT1.

The image signal DATA1 and the vertical synchronization signal Vsync, the horizontal synchronization signal Hsync, and a synchronization signal of the main clock signal MCLK are processed from the external input signal.

The image signal DATA1 is a signal processed to the image signal corresponding to the corresponding frame by classifying the external input signal into each frame unit.

In some cases, the image signal DATA1 may include image signals corresponding to a left eye view point and a right eye view point for implementing the 3D stereoscopic image.

In the case of the present example embodiment, the timing controller 40 arranges an image data signal of a first view point (left eye or right eye) and an image data signal of a second view point (right eye or left eye) from the external input signal according to vertical synchronization and horizontal synchronization to generate image data signals.

According to an example embodiment of the driving method of FIG. 2, data writing and emission simultaneously occur on the display panel. Thus, the entire scan period for the display panel may occur during a data writing period 3 almost equal to one frame (60 Hz). Therefore, the vertical synchronization signal Vsync may be transmitted every scan period corresponding to one frame. The horizontal synchronization signal Hsync is a frequency which is determined depending on the data writing period 3, which is a scan period of one frame, and may be set to a frequency required to activate the entire pixels for each pixel line during the data writing period 3.

The main clock signal MCLK may be either a clock signal having a reference frequency included in the external input signal or a clock signal generated by appropriate preprocessing.

Figure 4:
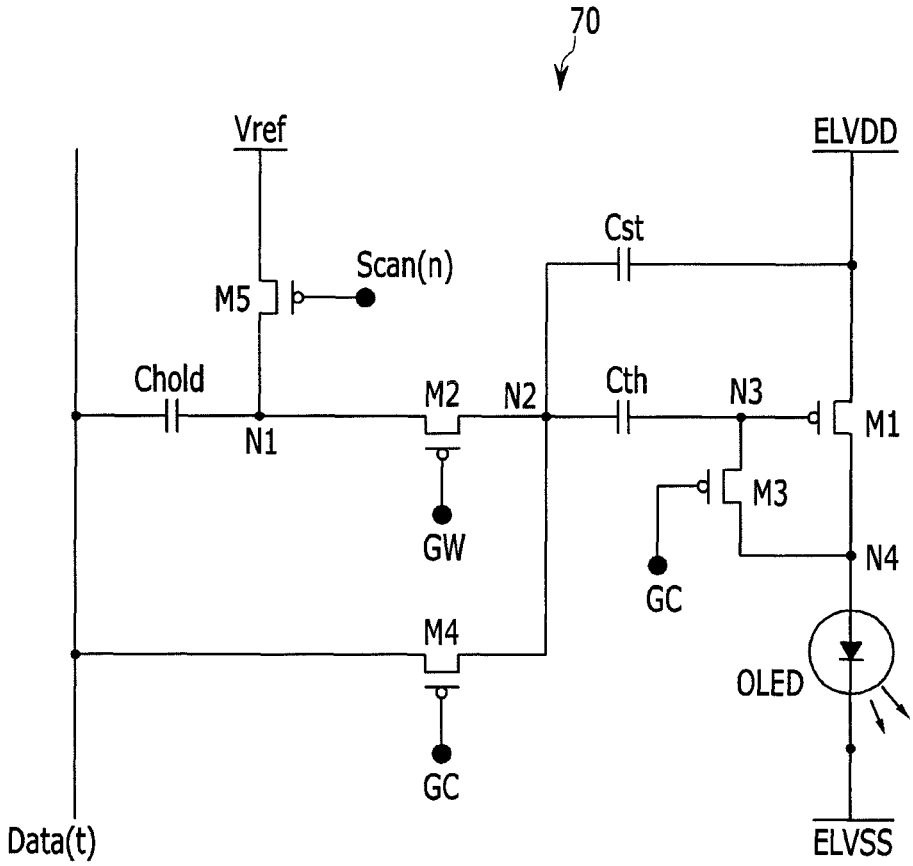
FIG. 4 is a circuit diagram showing the structure of a pixel included in the display device of FIG. 3 according to an example embodiment.

FIG. 4 is a circuit diagram showing the structure of a pixel 70 included in the display device of FIG. 3.

Referring to FIG. 4, the pixel 70 included in the display panel 10 of the display device according to an example embodiment includes an organic light emitting diode OLED for emitting light in response to an image data signal and a driving circuit. The driving circuit includes five transistors including a first transistor M1, a second transistor M2, a third transistor M3, a fourth transistor M4, and a fifth transistor M5, and three capacitors including a storage capacitor Cst, a compensation capacitor Cth, and a sustain capacitor Chold.

In general, a pixel circuit may include five to eight transistors and two or three capacitors to make use of the driving technology of a display device. Moreover, an additional power line for applying the reference voltage, reset voltage, or sustain voltage of the capacitors may be used to store a data voltage during one frame. With the general complicated pixel circuit structure and the additional power line, the production yield of the display device may be reduced, and it may become difficult to obtain a sufficient aperture ratio. Further, if stable and proper voltage supply is not achieved through a power line, the uniformity of display images of the display panel on the screen may be deteriorated.

Accordingly, a display device according to an embodiment may include the circuit of the pixel 70 of FIG. 4 including five transistors and three capacitors in order to improve performance and make use of the driving scheme according to the example embodiment of FIG. 2. Particularly, the pixel circuit is operated with respect to a data line designed for equivalent resistance and configured for independent potential supply according to the pixel circuit structure of FIG. 4, which may enable stable and uniform screen display.

The pixel 70 of FIG. 4 representatively illustrates a pixel included in an n-th pixel line, among the entire pixels of the display panel. Therefore, though not shown in FIG. 4, the pixel 70 is connected to a scan line corresponding to an n-th pixel column and a data line corresponding to a predetermined pixel row (hereinafter, referred to as an m-th pixel row) of pixels corresponding to the n-th pixel column.

Referring to FIG. 4, the first transistor M1 is a driving transistor which includes a drain electrode to which an anode of the organic light emitting diode OLED is connected, a gate electrode connected to a third node N3 to which one electrode of the third transistor M3 is connected, and a source electrode connected to a first power source voltage ELVDD. The driving transistor M1 controls the driving current supplied to the organic light emitting diode OLED in response to an image data signal corresponding to each pixel.

The second transistor M2 includes a source electrode connected to a first node N1, a gate electrode connected to a corresponding one of a plurality of second control signal lines to receive a second control signal GW, and a drain electrode connected to a second node N2.

The second transistor M2 transmits a voltage applied to the first node N1 to the second node N2 in response to the second control signal GW. Especially, the second transistor M2 transmits, to the second node N2, a data voltage corresponding to an image data signal of the previous frame transmitted to the first node N1, in response to the second control signal GW transmitted at a predetermined pulse voltage level during a data transmission period.

The third transistor M3 is a device including a gate electrode connected to a first control signal line through which a first control signal GC is transmitted and two electrodes respectively connected to the drain electrode and gate electrode of the first transistor M1. The third transistor M3 is a compensation transistor for compensating for a threshold voltage of the first transistor M1. The compensation transistor M3 diode-connects the drain electrode and gate electrode of the driving transistor M1 in response to the first control signal GC transmitted at a predetermined pulse voltage level during a period for compensating for a threshold voltage of the driving transistors in the driving method according to an example embodiment.

The fourth transistor M4 is a sustain transistor including a gate electrode connected to the first control signal line through which the first control signal GC is transmitted, a source electrode connected to a corresponding one of a plurality of data lines, and a drain electrode connected to the second node N2. The fourth transistor M4 functions to sustain the voltage of the second node N2 by applying, to the second node N2, a predetermined voltage Data(t) transmitted through the data line, in response to the first control signal GC transmitted at a predetermined pulse voltage level in a reset period, an initialization period, and a threshold voltage compensation period in the driving method according to an example embodiment.

The predetermined voltage Data(t) transmitted through the data line is a voltage Vdata for an image data signal corresponding to the current frame.

The fifth transistor M5 is a switching transistor including a gate electrode connected to a corresponding one of a plurality of scan lines to receive a corresponding scan signal Scan(n) and two electrodes respectively connected between the first node N1 to which one electrode of the sustain capacitor Chold is connected and a power line for transmitting the reference voltage Vref. The switching transistor M2 is turned on in response to the scan signal Scan(n) applied to the gate electrode, and transmits the reference voltage Vref applied through the power line to one electrode of the sustain capacitor Chold. Hence, the sustain capacitor Chold is able to store and sustain a voltage value corresponding to the difference between the voltage Vdata for the image data signal of the current frame from the data line and the reference voltage Vref.

The transistors of the pixel circuit of FIG. 4 all include, but not limited to, PMOS type transistors, and may include NMOS type transistors.

The storage capacitor Cst of the pixel 70 of FIG. 4 includes one electrode connected to the second node N2 and the other electrode connected to a supply source for supplying the first power source voltage ELVDD. The storage capacitor Cst is connected in series to the compensation capacitor Cth having one electrode commonly connected to the second node N2 connected to one electrode. The storage capacitor Cst stores the data voltage applied to the second node N2 as a predetermined value of the voltage distributed according to the connection relationship between the compensation capacitor Cth and the sustain capacitor Chold. The voltage applied to the second node N2 is a voltage value corresponding to the image data signal stored in the sustain capacitor Chold, and is applied to the second node N2 through the fourth transistor M4 during the data transmission period.

The storage capacitor Cst stores the voltage applied to the second node N2 as a voltage value corresponding to the capacitance ratio of compensation capacitors Cth connected in parallel while the organic light emitting diode emits light by the driving current corresponding to the image data signal of the previous frame.

The compensation capacitor Cth includes one electrode connected to the second node N2 and the other electrode connected to the third node N3 to which the gate electrode of the first transistor M1 is connected.

The compensation capacitor Cth maintains a voltage applied to the third node N3 to which the gate electrode of the first transistor M1 is connected, that is, a voltage considering the threshold voltage of the first transistor M1 during the threshold voltage compensation period according to the driving method of the present example embodiment.

The sustain capacitor Chold includes one electrode connected to the first node N1 and the other electrode connected to a corresponding one of the plurality of data lines. The sustain capacitor Chold writes a data voltage of an image data signal to be displayed in the next frame while the organic light emitting diode OLED of each pixel emits light by the driving current corresponding to the image data signal. In other words, the sustain capacitor Chold may receive a data voltage Vdata for an image data signal corresponding to the current frame through the data line and store the corresponding voltage value, while each pixel simultaneously emits light by the driving current for the image data signal written in the previous frame during the light emission period.

Hereinafter, the functions and operations of the pixel elements included in the pixel 70 of FIG. 4 will be described with respect to each driving period according to the driving method of the display device, in conjunction with the driving waveform diagram of FIG. 5.

Figure 5:
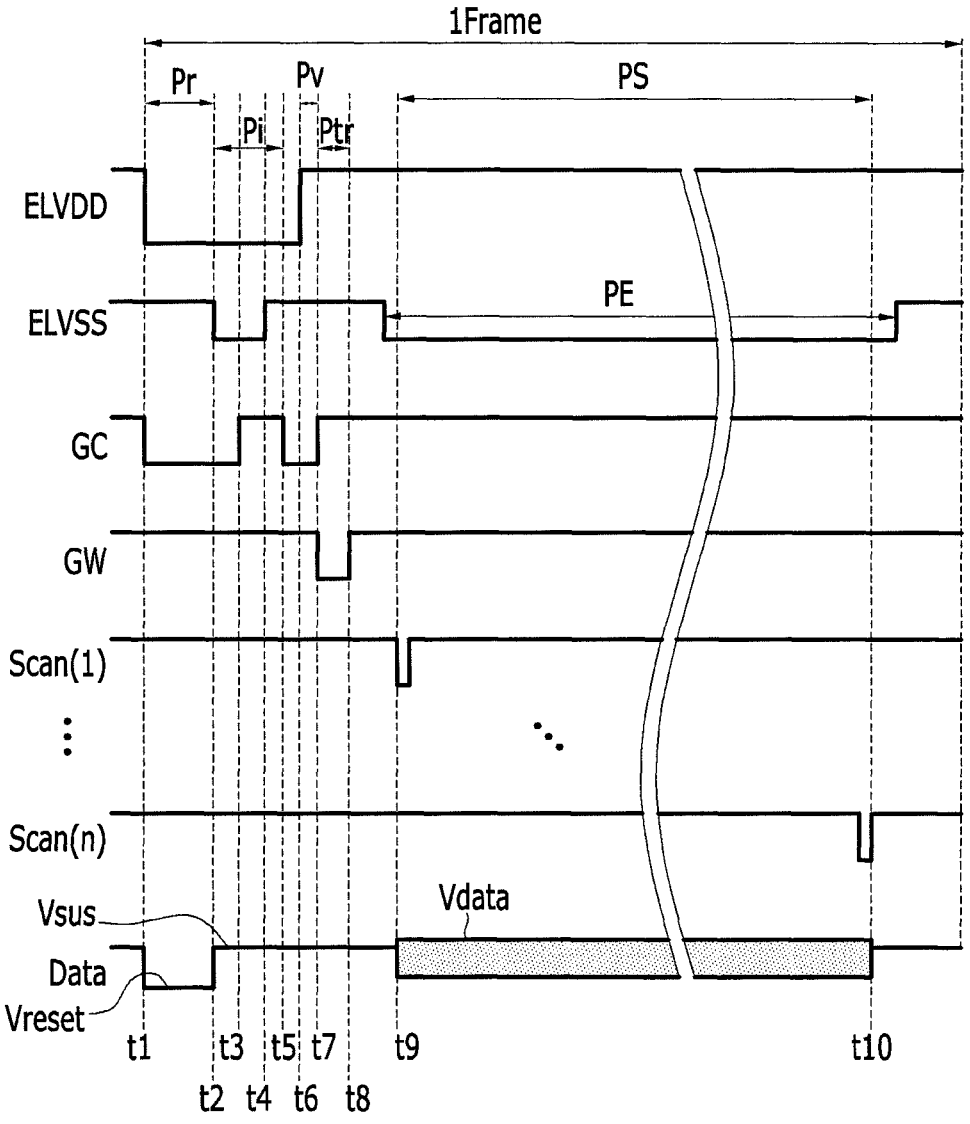
FIG. 5 is a driving waveform diagram of the pixel of FIG. 4.

FIG. 5 illustrates a voltage level of driving power supply voltage and pulse voltage levels of signals transferred through power supply lines or signal wires in order to operate each pixel for each driving period according to the driving method of the display device of the present invention.

FIG. 5 shows the voltage waveforms of a first power source voltage ELVDD, a second power source voltage ELVSS, a first control signal GC, and a second control signal GW which are transmitted to each pixel during one frame.

In addition, FIG. 5 illustrates scan signals scan(1)-scan(n) which are sequentially transferred to all the pixels along the pixel line and data voltage transferred through the data line corresponding to the corresponding pixel.

The sequence and procedure of the driving scheme according to the example embodiment of FIG. 5 are similar to those of the driving scheme of FIG. 2, except that an initialization period Pi is further included between a reset period Pr and a threshold voltage compensation period Pv, and a data transmission period Ptr is further included between the threshold voltage compensation period Pv and the data writing period PS, unlike FIG. 2.

First, the period between time t1 and time t2 is the reset period Pr. During the reset period Pr, the first control signal GC is transmitted to each of the gate electrodes of the third and fourth transistors M3 and M4 at a low-level pulse voltage.

Also, during the reset period Pr, the first power source voltage ELVDD, which is a driving voltage applied to the source electrode of the driving transistor M1 of each pixel, is set to a low-level voltage. The low-level voltage is not specifically limited, but may be approximately 0V.

Accordingly, during the reset period Pr, the first power source voltage ELVDD of low level is transmitted through the source electrode of the driving transistor M1, and the voltage of a fourth node N4, i.e., the drain electrode voltage of the driving transistor M1, is reset to the low-level voltage. At this point, the drain electrode and gate electrode of the driving transistor M1 are diode-connected through the third transistor M3 turned on in response to the first control signal GC. Thus, the voltage of the third node N3, i.e., the gate electrode voltage of the driving transistor M1, is also applied at the low-level voltage. Consequently, the first power source voltage ELVDD of low level is applied to the gate electrode, source electrode, and drain electrode of the driving transistor M1 to apply an off bias. The length of the reset period may be varied depending on the characteristics of the transistor.

During the reset period Pr, a voltage Data transmitted through a data line is applied to the second node N2 by the fourth transistor M4 turned on in response to the first control signal GC. The voltage Data may be set to a predetermined reset voltage Vreset, and the voltage value of the reset voltage Vreset is not specifically limited, but may be set to approximately 0 V. Accordingly, the voltage of the second node N2 is maintained at a low-level voltage during the reset period.

Next, the period between time t2 and time t5 is an initialization period Pi.

Among the driving voltages transmitted to all the pixels at time t2, the second power source voltage ELVSS is changed to a predetermined low level and transmitted. The second power source voltage ELVSS of low level is not specifically limited, but may be approximately 0 V. When the second power source voltage ELVSS connected to a cathode of the organic light emitting diode OLED is lowered, the voltage of the fourth node N4 instantly becomes lower. Since the first control signal GC is transmitted with a pulse of low level in the period between time t2 and time t3, the third transistor M3 is still kept turned on. Therefore, the driving transistor M1 is diode-connected. Then, the voltage of the third node N3 is lowered.

Next, when the first control signal GC is changed to a high-level pulse at time t3, and the second power source voltage ELVSS rises to high level at time t4, the third transistor M3 is turned off, the diode connection of the driving transistor M1 is released, and the fourth node N4 also rises due to the rise of the second power source voltage ELVSS. However, the voltage of the third node N3 is kept low by a serial connection between the storage capacitor Cst and the compensation capacitor Cth. Accordingly, the driving transistor M1 is kept turned on, and the drain electrode voltage of the driving transistor M1, i.e., the voltage of the fourth node N4, is lowered again to the first power source voltage ELVDD of low level due to the first power source voltage ELVDD of low level transmitted to the source electrode of the driving transistor M1.

The fourth transistor M4 is also kept turned on because the first control signal GC maintains the pulse voltage of low level during the period between time t2 and time t3 of the initialization period Pi. Since the voltage Data transmitted through the data line rises to a predetermined voltage value at time t2, the raised voltage value is transmitted to the second node N2 through the fourth transistor M4. The raised voltage value is a sustain voltage Vsus, and is not specifically limited, but may be determined approximately between 6V and 13V which falls within the voltage range of an image data signal.

Next, the first control signal GC is dropped from high level to a low level pulse voltage and transmitted at time t5. Then, the first power source voltage ELVDD rises to high level and is transmitted at time t6. The voltage value of the first power source voltage ELVDD of high level is not specifically limited, but may be approximately 12 V.

The period between time t6 and time t7 is a threshold voltage compensation period Pv.

During the threshold voltage compensation period Pv, the fourth node N4 connected to the drain electrode of the driving transistor M1 and the third node N3 connected to the drain electrode of the driving transistor M1 are diode-connected through the turned-on third transistor M3, and the voltage of the third node N3 and the fourth node N4 is maintained at a value obtained by taking into account the threshold voltage (hereinafter, Vth) of the driving transistor M1 and the voltage value of the first power source voltage ELVDD of high level. The value of the raised first power source voltage ELVDD is especially referred to as ELVDD_high.

That is, the voltage of the third node N3 and the fourth node N4 is maintained at the sum ELVDD_high+Vth of the high-level first power source voltage ELVDD_high and the threshold voltage Vth by the turned-on driving transistor M1 and the turned-on compensation transistor M3.

During the threshold voltage compensation period Pv, the fourth transistor M4 is turned on by the first control signal GC transmitted at the low-level pulse voltage. Thus, a predetermined sustain voltage Vsus applied to the data line of each pixel may be applied to the second node N2.

That is, the second node of each pixel may be applied with a reset voltage Vreset transmitted through the data line during the reset period Pr, and then applied with a sustain voltage Vsus transmitted through the data line during the threshold voltage compensation period Pv.

Next, the period between time t7 and time t8 is a data transmission period Ptr.

The first control signal GC rises to high level at time t7, and the second control signal GW is at high level during the previous period (reset period, initialization period, and compensation period) and then dropped to low level and transmitted at time t7.

Then, the third transistor M3 and the fourth transistor M4 are turned off, and the second transistor M2 is turned on. Accordingly, the voltage applied to the first node N1 is transmitted to the second node N2 through the turned-on second transistor M2.

The voltage applied to the first node N1 is a voltage corresponding to the data voltage of the image data signal written in the sustain capacitor Chold during the previous frame.

That is, since the data voltage of the image data signal is transmitted to one end of the sustain capacitor Chold through the data line during the data writing period of the previous frame and the reference voltage Vref is transmitted to the other end of the sustain capacitor Chold, the sustain capacitor Chold stores a voltage corresponding to the voltage difference between both ends thereof. For better understanding and ease of description, the data voltage of the image data signal written in the current frame is denoted by Vdata, and the data voltage of the image data signal written in the previous frame is denoted by Vdata_0. As such, the voltage value stored in the sustain capacitor Cold of the pixel according to the example embodiment is represented by Vref−Vdata_0.

The plurality of scan signals Scan(1)-Scan(n) simultaneously transmitted to the gate electrodes of the fifth transistors M5 of all the pixels have a high-level pulse voltage. Hence, the fifth transistor M5 is in the turned-off state.

Although the voltage Vref−Vdata_0 corresponding to the data voltage of the previous frame applied to the first node N1 has to be transmitted to the second node N2 through the turned-on second transistor M2 during the data transmission period Ptr, the voltage shown in the following Equation is applied to the second node N2 due to the storage capacitor Cst and compensation capacitor connected in parallel with the sustain capacitor Chold.

$$\text{Voltage of second node } N2(\text{V_N2}) = \text{voltage of previous second node } N2 + \text{amount of voltage change of second node } N2 * [\text{C_hold}/(\text{C_hold} + Cx)] = Vsus + (\text{Vref_Vdata_0}) * \alpha \quad \text{(Equation 1)}$$

where α=C_hold/(C_hold+Cx),

Cx=C_st+C_th,

C_st is the capacitance of the storage capacitor,

C_th is the capacitance of the compensation capacitor, and

C_hold is the capacitance of the sustain capacitor.

While passing through the reset period Pr, initialization period Pi, and compensation period Pv, the voltage of the second node N2 is applied as the sustain voltage Vsus transmitted to each pixel through the data line. When the voltage of the second node N2 is changed by the value of the data voltage Vdata_0 stored in the previous frame, the amount of change is determined based on the ratio of the capacitances of the storage capacitor Cst, compensation capacitor Cth, and sustain capacitor Chbold commonly connected to the second node N2.

The voltage of the third node N3 is maintained at the voltage ELVDD_high+Vth, which is obtained by increasing the threshold voltage Vth of the driving transistor by the first power source voltage ELVDD of high level, and then is changed based on the amount of change of the second node N2.

The voltage of the third node N3 is represented by the following Equation.

$$\text{Voltage of third node } N3(\text{V_N3}) = \text{voltage of previous third node } N3 + \text{voltage change of second node } N2 * [\text{C_hold}/(\text{C_hold} + Cx)] = \text{ELVDD_high} + Vth + (\text{Vref_Vdata_0}) * \alpha \quad \text{(Equation 2)}$$

(the capacitance of parasitic capacitors will be ignored)

where α=C_hold/(C_hold+Cx),

Cx=C_st+C_th.

Subsequently, a corresponding one of the scan signals scan(1)-scan(n) is changed to low level sequentially for each pixel line and transmitted to each of the fifth transistors M5 of the entire pixels during the period from time t9 to time t10. The period between time t9 and time t10 is a data writing period in which the scan signals Scan(1)-Scan(n) are sequentially transmitted for each pixel line to activate each pixel and write a data voltage Vdata of the image data signal of the current frame.

Specifically, the first scan signal Scan(1) to the last scan signal Scan(n) are changed to a low-level pulse voltage for each pixel line, and transmitted to the fifth transistor M5 of each pixel. The fifth transistor M5 of each pixel is sequentially turned on to transmit the reference voltage Vref to the first node N1. The data voltage Vdata of the image data signal of the current frame sequentially transmitted through the corresponding data line is transmitted to one end of the sustain capacitor Chold.

Then, the sustain capacitor Chold stores the voltage corresponding to a potential difference between both ends. The voltage value of the image data signal of the current frame stored in the sustain capacitor Chold during the data writing period PS is denoted by Vref−Vdata.

During a period equal to or longer than the data writing period PS, each pixel simultaneously emits light by the driving current corresponding to the data voltage Vdata_0 of the image data signal written in the previous frame to display an image. That is, in the driving method according to an example embodiment, the light emission period and data writing period of each pixel occurs simultaneously.

Referring to FIG. 5, it can be seen that the light emission period PE in which each pixel simultaneously emits light by the driving current of the image data signal written in the previous frame is longer than the data writing period PS in which the image data signal of the current frame is written. In some cases, the light emission period PE and the data writing period PS may occur simultaneously.

Specifically, the light emission period PE begins as the voltage level of the second power source voltage ELVSS is converted to low level before time t8 at which the data writing period PS begins. The low-level voltage of the second power source voltage ELVSS is not specifically limited, but may be less than 0 V.

Then, the voltage of the cathode of the organic light emitting diode to which the second power source voltage ELVSS is applied is converted to low level. Thus, driving current flows toward the organic light emitting diode OLED included in each of the pixels on the display panel of the display device. The driving current corresponds to the data voltage Vdata_0 of the image data signal transmitted in the previous frame. Then, an image corresponding to the image data signal transmitted in the previous frame can be displayed simultaneously on the entire display panel during the light emission period PE.

The driving current I_OLED flowing toward the organic light emitting diode OLED during the light emission period is represented by the following Equation.

$$\text{I_OLED} = k(Vgs - Vth)^2 = k\left(\frac{\text{ELVDD_high} + Vth + (Vref - \text{Vdata_0}) * \alpha - \text{ELVDD_high} - Vth}{}\right)^2 \quad \text{(Equation 3)}$$

where k is a proportionality constant depending on material characteristics of the driving transistor.

According to Equation 3, a display image emitted simultaneously from the entire pixels of the display panel during the light emission period PE is not affected by the threshold voltage Vth of the driving transistor and the voltage level of the first power source voltage ELVDD, and is uniformly displayed as the driving current corresponding to the image data signal flows.

As described above, emission and data writing operations for one frame occur simultaneously in the driving procedure according to an example embodiment. Thus, scanning can be performed at a rate of nearly 60 Hz, rather than 240 Hz for high-speed driving, over the time period of one frame, thereby enabling simultaneous emission and ensuring sufficient data writing time. In the case of a driving operation for stereoscopic image display, a scan period for realizing each viewpoint can occur at a rate of nearly 120 Hz.

Figure 6:
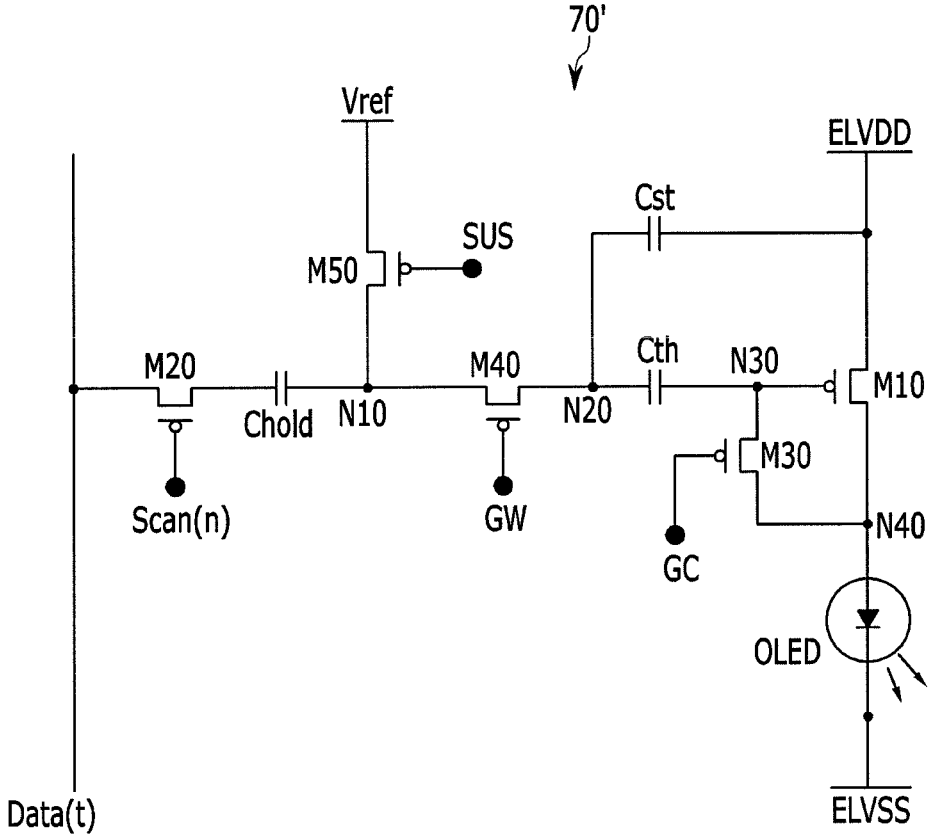
FIG. 6 is a circuit diagram showing the structure of a pixel 70' included in the display device of FIG. 3 according to another example embodiment.

FIG. 6 is a circuit diagram showing the structure of a pixel 70' included in the display device of FIG. 3 according to another example embodiment.

The structure of the pixel 70' of FIG. 6 further includes a switching element M20 for connecting the storage capacitor Cst and the corresponding data line when necessary, unlike the pixel 70 of FIG. 4. Also, the fourth transistor M4 of FIG. 4 can be omitted by allowing the fifth transistor M50 of FIG. 6 to perform the function of the fourth transistor M4, among the circuit elements of the pixel of FIG. 4.

Therefore, the total number of transistors of the pixel circuit is still five.

Referring to the pixel of FIG. 6, the configurations and connections of the first transistor M10, third transistor M30, fourth transistor M40, fifth transistor M50, storage capacitor Cst, compensation capacitor Cth, and sustain capacitor Chold are sequentially similar to those of the first transistor M1, third transistor M3, second transistor M2, fifth transistor M5, storage capacitor Cst, compensation capacitor Cth, and sustain capacitor Chold of the pixel of FIG. 4. Accordingly, a description of the pixel device of FIG. 6 having the same connection structure as the pixel device of the pixel of FIG. 4 will be omitted.

However, the gate electrode of the fifth transistor M50 of the pixel of FIG. 6 is connected to a corresponding one of the plurality of third control signal lines to receive a third control signal sus. One end of the sustain capacitor Chold of the pixel of FIG. 6 is connected, not to the corresponding data line as shown in FIG. 4, but to the second transistor M20 connected. That is, the sustain capacitor Chold of the pixel of FIG. 6 includes one electrode connected to the first node N10 and the other electrode connected to the drain electrode of the second transistor M20.

The difference between the pixel structure of FIG. 6 and that of FIG. 4 is the second transistor M20. The second transistor M20 is a switching transistor including a gate electrode connected to a corresponding one of the plurality of scan lines to receive a corresponding scan signal Scan(n), a source electrode connected to a corresponding data line, and a drain electrode connected to one electrode of the sustain capacitor Chold.

Figure 7:
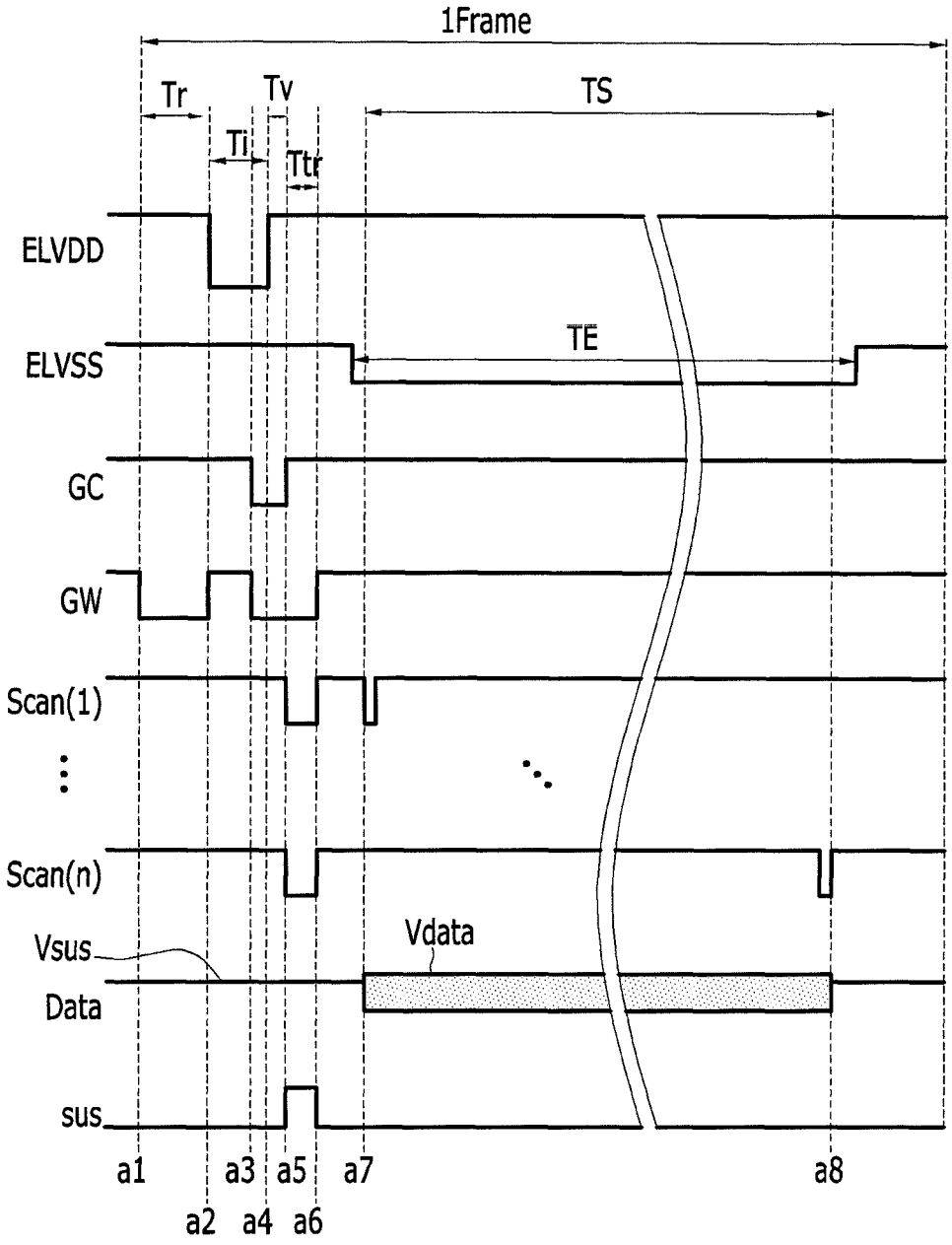
FIG. 7 is a driving waveform diagram of the pixel of FIG. 6.

The driving waveform diagram of the pixel of FIG. 6 is illustrated in FIG. 7.

FIG. 7 shows the voltage waveforms of a first power source voltage ELVDD, second power source voltage ELVSS, first control signal GC, second control signal GW, and third control signal sus which are transmitted to each pixel during one frame.

Also, FIG. 7 illustrates scan signals scan(1)-scan(n) which are sequentially transferred to all the pixels along the pixel line and data voltage transferred through the data line corresponding to the corresponding pixel.

Like the driving scheme of FIG. 5, the driving scheme according to the example embodiment of FIG. 7 includes an initialization period Ti between a reset period Tr and a threshold voltage compensation period Tv, and a data transmission period Ttr between the threshold voltage compensation period Tv and the data writing period TS.

First, during the reset period Tr between time a1 and time a2, the first power source voltage ELVDD, which is a driving voltage applied to the source electrode of the driving transistor M10 of each pixel, is set to a high-level voltage. The high-level voltage is not specifically limited, but may be approximately 12 V.

During this period, the second control signal GW is transmitted to the gate electrode of the fourth transistor M40 at a low-level pulse voltage. During this period, the first control signal GC is transmitted to the gate electrode of the third transistor M30 at a high-level pulse voltage. Accordingly, an on bias can be applied to the driving transistor M10.

The third control signal sus transmitted to the gate electrode of the fifth transistor M50 during the reset period has a low-level pulse voltage. Thus, the fifth transistor M50 is turned on to transmit a reference voltage Vref to the second node N20 through the fourth transistor M40. The voltage value of the reference voltage Vref is not specifically limited, but may be an appropriately low voltage.

Next, the period between time a2 and time a4 is an initialization period Ti.

Among the driving voltages transmitted to all the pixels at time a2, the first power source voltage ELVDD is changed to a predetermined low level and transmitted. The first power source voltage ELVDD of low level is not specifically limited, but may be approximately 0 V.

The second controls signal GW is changed to a high-level pulse voltage at time a2, and therefore the fourth transistor M40 is turned off.

Then, the first control signal GC and the second control signal GW are transmitted at a low-level pulse voltage at time a3 of the initialization period Ti.

Next, the drain electrode voltage of the driving transistor M10, i.e., the voltage of the fourth node N40, is lowered due to the first power source voltage ELVDD of low level, and the gate electrode and drain electrode of the driving transistor M10 are diode-connected through the third transistor M30 turned on in response to the first control signal GC. Accordingly, the gate electrode voltage of the driving transistor M10, i.e., the voltage of the third node N30, is lowered to the first power source voltage ELVDD of low level.

Next, the first power source voltage ELVDD rises to high level at time a4, and the first control signal GC and the second control signal GW are transmitted still at the low-level pulse voltage during the period from time a4 to a5.

The period between time a4 and time a5 is a threshold voltage compensation period Tv.

During the threshold voltage compensation period Tv, the drain electrode and gate electrode of the driving transistor M10 are diode-connected through the turned-on third transistor M30, and a voltage ELVDD_high+Vth obtained by taking into account the threshold voltage Vth of the driving transistor M10 and the first power source voltage ELVDD_high of high level is applied to the third node N30.

During the threshold voltage compensation period Tv, the fourth transistor M40 is turned on by the second control signal GW transmitted at the low-level pulse voltage. Thus, the second node N20 is still maintained at the reference voltage Vref transmitted through the fifth transistor M50.

Next, the period between time a5 and time a6 is a data transmission period Ttr.

At time a5, the first control signal GC and the third control signal sus is shifted to a high-level voltage, and the plurality of scan signals Scan(1)-Scan(n) simultaneously transmitted to the gate electrodes of the second transistors M20 of all the pixels are changed to a low-level voltage. During the data transmission period Ttr, the second control signal GW is still transmitted at the low level.

Then, the second transistors M20 of all the pixels are turned on, and the voltage value Vref−Vdata_0 corresponding to the image data signal stored in the sustain capacitor Chold during the data writing period of the previous frame is transmitted to the second node N20 through the fourth transistor M40. Therefore, the voltage of the second node N20 is represented by the following Equation 4.

$$\text{Voltage of second node } N20(\text{V_N20}) = \text{voltage of previous second node } N20 + \text{voltage change of second node } N20 * [\text{C_hold}/(\text{C_hold} + Cx)] = Vref + (Vref - \text{Vdata_0}) * \alpha \quad \text{(Equation 4)}$$

where $\alpha$=C_hold/(C_hold+Cx),

Cx=C_st+C_th.

The voltage of the third node N3 is maintained at the voltage ELVDD_high+Vth, which is obtained by increasing the threshold voltage Vth of the driving transistor by the first power source voltage ELVDD of high level, and then is changed based on the amount of change of the second node N20.

The voltage of the third node N3 is represented by the following Equation.

$$\text{Voltage of third node } N30(\text{V_N30}) = \text{voltage of previous third node } N30 + \text{voltage change of second node } N20 * [\text{C_hold}/(\text{C_hold} + Cx)] = \text{ELVDD_high} + Vth + (\text{Vref_Vdata_0}) * \alpha \quad \text{(Equation 5)}$$

(the capacitance of parasitic capacitors will be ignored)

where $\alpha$=C_hold/(C_hold+Cx),

Cx=C_st+C_th

Subsequently, a corresponding one of the scan signals scan (1)-scan(n) is changed to low level sequentially for each pixel line and transmitted to each of the second transistors M20 of the entire pixels during the period from time a7 to time t10. The period between time a7 and time a8 is a data writing period in which a data voltage Vdata of the image data signal of the current frame is written sequentially for each pixel line.

Specifically, the second transistor M20 of each pixel is sequentially turned on to transmit the data voltage Vdata of the image data signal of the current frame sequentially transmitted through the corresponding data line to one end of the sustain capacitor Chold.

As the third control signal sus is transmitted at the low-level pulse voltage during the data writing period TS to turn on the fifth transistor M50, a predetermined reference voltage Vref is applied to the first node N10 connected to the other end of the sustain capacitor Chold.

Then, the sustain capacitor Chold stores the voltage corresponding to a potential difference between both ends. The voltage value of the image data signal of the current frame stored in the sustain capacitor Chold during the data writing period PS is denoted by Vref−Vdata.

During a period equal to or longer than the data writing period TS, each pixel simultaneously emits light by the driving current corresponding to the data voltage Vdata_0 of the image data signal written in the previous frame to display an image.

Specifically, a light emission period TE begins as the voltage level of the second power source voltage ELVSS is converted into the low level before time a7 at which the data writing period TS begins.

The driving current I_OLED flowing toward the organic light emitting diode OLED during the light emission period is represented by the following Equation.

$$\text{I_OLED} = k(Vgs - Vth)^2 = k\left(\text{ELVDD_high} + Vth + \begin{matrix}(Vref - \text{Vdata_0}) * \\ \alpha - \text{ELVDD_high} - Vth\end{matrix}\right)^2 = k[\alpha * (Vref - \text{Vdata_0})]^2 \quad \text{(Equation6)}$$

where k is a proportionality constant depending on material characteristics of the driving transistor.

Based on Equation 6, it can be seen that the pixel and the driving method thereof according to the example embodiment as shown in FIGS. 6 and 7 are different from the above-described pixel and driving method according to the example embodiment as shown in FIGS. 4 and 5 in terms of pixel structure, but are identical thereto in terms of the amount of driving current.

That is, a display image emitted simultaneously from the entire pixels of the display panel during the light emission period PE is not affected by the threshold voltage Vth of the driving transistor and the voltage level of the first power source voltage ELVDD, and is uniformly displayed as the driving current corresponding to the image data signal flows.

Figure 8:
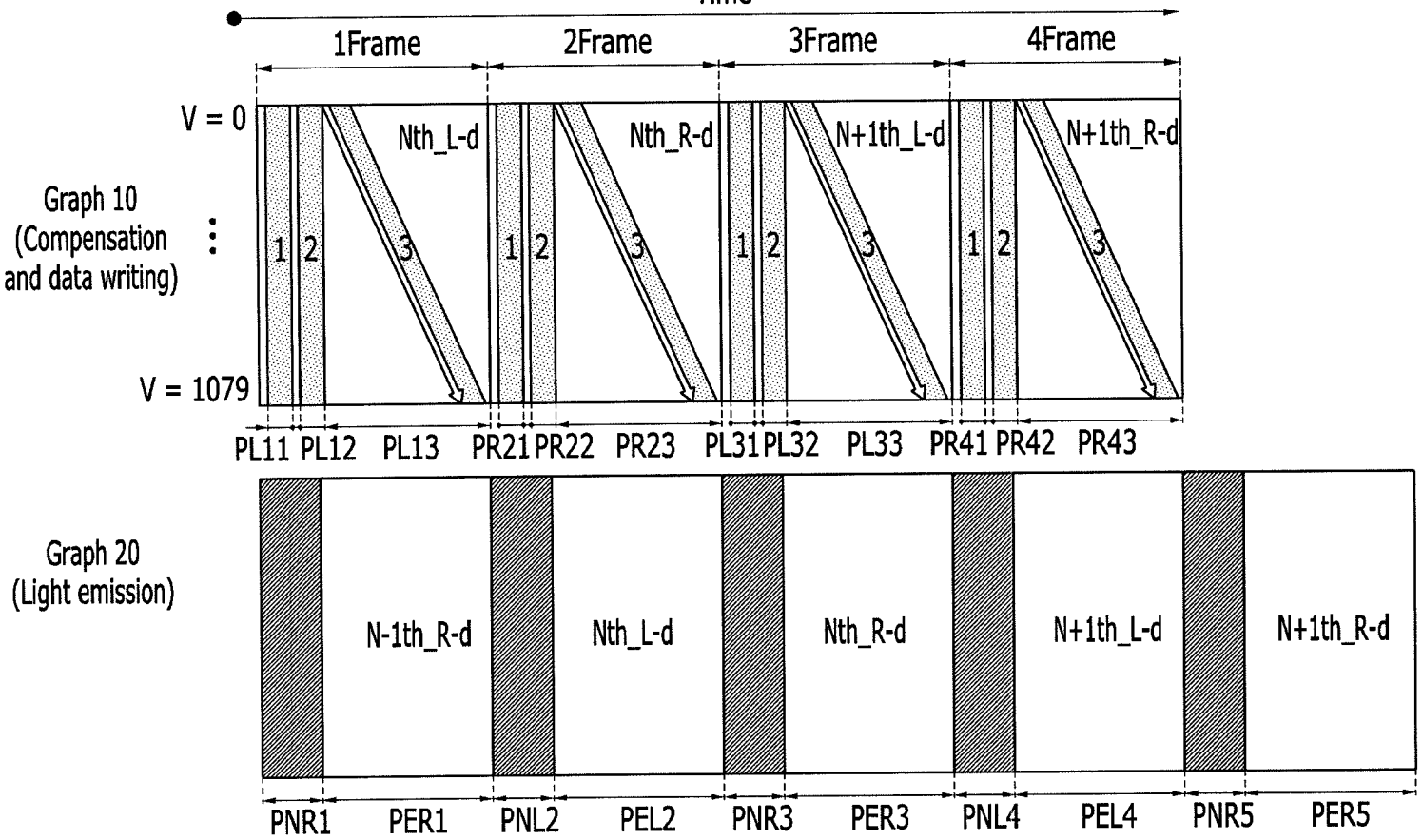
FIG. 8 is a view showing a driving scheme of a display device according to another example embodiment.

FIG. 8 is a view showing a driving scheme of a display device according to another example embodiment, particularly, a driving scheme for displaying a 3-dimensional stereoscopic image.

Like the driving scheme of FIG. 2, FIG. 8 depicts Graph 10 showing a process of compensating for a threshold voltage and writing data and Graph 20 showing an emission process, both of which are presented over the same period of time.

In FIG. 8, one viewpoint (left eye or right-eye) image is displayed for each frame. However, embodiments are not limited thereto and a frame may be driven to display different viewpoint image at a time within the frame.

The driving method according to an embodiment may be equally applied even to the high-speed stereoscopic image driving method.

Referring to FIG. 8, each of a plurality of frames includes a reset period 1, a threshold voltage compensation period 2, a data writing period 3, and a light emission period 4, and the data writing period 3 and the light emission period 4 occur simultaneously. That is, referring to Graph 10 presented in terms of compensation and data writing, a reset period 1, a threshold voltage compensation period 2, a data writing period 3 for writing a data voltage of a first viewpoint (left eye or right-eye) image data signal, a reset period 1, a threshold voltage compensation period 2, and a data writing period 3 for writing a data voltage of a second viewpoint (right eye or left-eye) image data signal are repeated during consecutive frames.

In another embodiment, as stated above, an initialization period and a data transmission period may be further included in the above-described driving procedure.

Referring to Graph 20 presented in terms of emission, a non-light emission period, a light emission period for causing the entire pixels to simultaneously emit light by driving current corresponding to a first viewpoint (left eye or right-eye) image data signal, a non-light emission period, and a light emission period for causing the entire pixels to simultaneously emit light by driving current corresponding to a second viewpoint (right eye or left-eye) are repeated during consecutive frames.

Specifically, according to the example embodiment of FIG. 8, a left eye image and a right eye image are displayed for each frame according to driving time.

First of all, all pixel circuits of the display panel are simultaneously reset during a reset period PL11 of a first frame 1Frame. Next, the threshold voltage of each of the driving transistors included in the entire pixel circuits of the display panel is simultaneously compensated for during a threshold voltage compensation period PL12. The reset period PL11 and threshold voltage compensation period PL12 of the first frame 1Frame correspond to a non-light emission period PNR1.

Next, a left eye image data signal Nth_L-d to be displayed in the light emission period PEL2 of a second frame 2Frame, i.e., the next frame, is sequentially written during the data writing period PL13 of the first frame 1Frame. At the same time, the entire pixels of the display panel simultaneously display an image corresponding to a right eye image data signal N−1th_R-d of the previous frame stored in each pixel during the light emission period PER1 of the first frame 1Frame.

During the second frame 2Frame subsequent to the first frame, a reset period PR21 for resetting the data voltage of the left eye image data signal Nth_L-d written in the first frame, a threshold voltage compensation period PR22 for compensating the threshold voltage of the driving transistor of each pixel of the display panel, and a data writing period PR23 for sequentially writing a right eye image data signal Nth_R-d corresponding to the second frame on each pixel are consecutively provided in the same manner as the first frame 1Frame.

As described above, the entire pixels emit light by the driving current corresponding to the left eye image data signal stored in the data writing period PL13 of the first frame 1Frame during the light emission period PEL2, simultaneously with the data writing period PR23 of the second frame 2Frame.

The right eye image data signal Nth R-d sequentially written in the data writing period PR23 of the second frame 2Frame allows the entire pixels to simultaneously emit light by the corresponding driving current during the light emission period PER3 of a third frame 3Frame.

Accordingly, the light emission period PEL2 of the second frame 2Frame and the light emission period PER3 of the third frame 3Frame are consecutively provided to display a left eye image and a right eye image, thereby realizing a 3-dimensional stereoscopic image.

According to the stereoscopic image driving method of FIG. 8, the left eye image data signals and right eye image data signals are alternately written in sequence and the inputted left eye image data and right eye image data simultaneously emit the light in sequence, thereby expressing the 3D images.

In this case, the light emitting duration may be freely set regardless of scanning of each pixel of the display panel.

Accordingly, a time interval between the respective view point images may be set so as to be optimized by a response speed of liquid crystal shutters of shutter glasses of a stereoscopic display device and the like.

According to the pixel circuit and the driving method thereof according to example embodiments, the elements of each pixel are operated based on a voltage applied through data lines, thus achieving a stable and uniform screen display.

By way of summation and review, a display device including a large-sized display panel or a high-speed frame driving for driving of the 3D stereoscopic image is desired, but since respective periods for initialization of data voltage, compensation of threshold voltage of a driving transistor, writing of data, and light emission may not be sufficiently ensured by the high-speed driving mode, it may be difficult to implement images having accurate luminance. Further, pixel circuit structure may become complicated and power consumption may be increased by a luminance compensation or other the driving mode. Thus, production costs may increase and non-uniformity of luminance may not be significantly improved. Thus, simplification of pixel circuits and wirings, a simple displacement of layouts, ensuring for a sufficient period of each driving process, and ensuring for a manufacturing yield and an aperture ratio of the display panel is desired.

As described above, embodiments may provide a display panel that provides a sufficient period of each driving stage of a display device and includes a simplified pixel circuit. Further, embodiments may provide a display device that addresses non-uniformity related to the position of an additional reference wire provided to transmit a reference voltage in a general display device. Further, embodiments may allow a display device to realize an image with accurate luminance and high quality by providing a sufficient period of time to compensate for a threshold voltage of a transistor and sufficient periods of time for data writing and light emission in a driving procedure of the display device.

According embodiments, sufficient periods of time may be provided for the driving steps of the display device, including data voltage initialization, transistor threshold voltage compensation, data writing, and light emission, which may help achieve uniformity of an image on the display panel and display an image with accurate luminance. Moreover, while a general display device may show deteriorations in screen quality and uniformity because of non-uniformity related to the position of an additional reference wire provided to transmit a reference voltage, a display device according to an embodiment may be operated based on the potential of a data line for data transmission, thereby addressing the issue of screen non-uniformity. Furthermore, embodiments may provide a method for driving a display device that is made in a large size, has a high resolution, and is operable at high frequency.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

Those skilled in the art may easily select and substitute the drawings and details of the disclosed description. Those skilled in the art may omit some of the constituent elements described in the present specification without deteriorating performance thereof or can add constituent elements to improve performance thereof. Those skilled in the art may modify the sequence of the steps of the method described in the present specification depending on the process environment or equipment.

<Description of symbols>

| | |
|---|---|
| 10: display panel | 20: scan driver |
| 30: data driver | 40: timing controller |
| 50: power supply controller | 60: compensation control signal unit |
| 70: pixel | |

What is claimed is:

1. A display device, comprising:

a display panel, the display panel including a plurality of pixels that, during one frame, receive a first voltage transmitted through a data line and a second voltage having a higher level than the first voltage, receive and store a third voltage of a first image data signal of a current frame, and emit light by a driving current for a fourth voltage of a second image data signal of a previous frame, wherein, of one frame, a data writing period for storing the third voltage and a light emission period for emitting light by the driving current for the fourth voltages overlap each other, wherein each of the plurality of pixels includes:

an organic light emitting diode;

a first transistor to transmit the driving current to the organic light emitting diode;

a second transistor including electrodes connected to first and second contact points, respectively;

a fourth transistor between the data line and the first contact point, the fourth transistor to transmit the first voltage and the second voltage to the first contact point;

a storage capacitor to store the fourth voltage of the second image data signal of the previous frame during a data transmission period, the storage capacitor including electrodes connected to a source electrode of the first transistor and the first contact point, respectively; and a sustain capacitor to store the third voltage of the first image data signal of the current frame during the data writing period, the sustain capacitor including a first electrode connected to the data line and a second electrode connected to the second contact point, and wherein:

the second transistor is turned off during the light emission period, and the fourth transistor is turned off during the data writing period.

2. The display device as claimed in claim 1, wherein the first image data signal is a first viewpoint image data signal or a second viewpoint image data signal corresponding to the current frame, the second image data signal is a first viewpoint image data signal or a second viewpoint image data signal corresponding to the previous frame, and viewpoints of the first image data signal and the second image data signal are different.

3. The display device as claimed in claim 1, wherein one frame comprises:

a reset period for transmitting the first voltage to one end of a compensation capacitor connected to a gate electrode of the first transistor through the data line;

an initialization period for applying a first power source voltage of a first level from a power supply unit and setting a drain electrode voltage of the first transistor to the first level;

a compensation period for simultaneously compensating for a threshold voltage of the first transistor of each of the plurality of pixels;

the data transmission period for transmitting the fourth voltage to one end of the compensation capacitor, wherein:

the data writing period is for storing the third voltage in response to a plurality of scan signals sequentially transmitted to the plurality of pixels; and the light emission period is for allowing the organic light emitting diode of each of the plurality of pixels to simultaneously emit light by the driving current for the fourth voltage transmitted in the data transmission period, the light emission period overlapping the data writing period.

4. The display device as claimed in claim 3, wherein the data writing period is equal to or shorter than the light emission period.

5. The display device as claimed in claim 3, wherein a duration of the reset period during one frame is determined depending on material characteristics of the first transistor.

6. The display device as claimed in claim 3, wherein all of the pixels do not emit light during the reset period, the initialization period, the compensation period, and the data transmission period.

7. The display device as claimed in claim 1, wherein the first voltage has a gate-on voltage level for turning on elements of each pixel.

8. The display device as claimed in claim 1, wherein the second voltage is set to a voltage value between lowest and highest values of a data voltage of an image data signal.

9. The display device as claimed in claim 1, wherein an amount of driving current is determined by taking into account an amount of voltage change according to a capacitance ratio of a storage element connected to one end of a compensation capacitor connected to a gate electrode of the first transistor of the pixel, with respect to the fourth voltage.

10. The display device as claimed in claim 1, wherein each of the plurality of pixels comprises:

a third transistor between a gate electrode and a drain electrode of the first transistor and diode-connects the gate electrode and the drain electrode of the first transistor;

a fifth transistor that transmits a predetermined reference voltage applied from a power supply line to the second contact point connected to one electrode of the second transistor, in response to a corresponding one of a plurality of scan signals; and a compensation capacitor including electrodes connected between the gate electrode of the first transistor and the first contact point, respectively.

11. The display device as claimed in claim 10, wherein the sustain capacitor stores the third voltage until a data transmission period of a next frame, and stores the fourth voltage until a data transmission period of the current frame.

12. The display device as claimed in claim 10, wherein a first power source voltage applied to the source electrode of the first transistor is transmitted at low level during a reset period and an initialization period, a second power source voltage applied to the drain electrode of the first transistor is transmitted at low level during the initialization period and a light emission period, the plurality of scan signals are sequentially transmitted at a gate-on voltage level for each pixel line during the data writing period, a first control signal transmitted to gate electrodes of the third transistor and the fourth transistor is transmitted at a gate-on voltage level during the reset period and a compensation period, and is changed from the gate-on voltage level to a gate-off voltage level and transmitted during the initialization period, and a second control signal transmitted to a gate electrode of the second transistor is transmitted at a gate-on voltage level during a data transmission period.

13. The display device as claimed in claim 10, wherein the first voltage is applied through the data line connected to a source electrode of the fourth transistor during a reset period while the third transistor and the fourth transistor are in a turned-on state, and the second voltage is applied through the data line during an initialization period and a compensation period while the third transistor and the fourth transistor are in the turned-on state.

14. The display device as claimed in claim 1, further comprising:

a scan driver that generates and transmits a plurality of scan signals for activating driving of the plurality of pixels;

a data driver that transmits the first voltage, the second voltage, or a data voltage of an image data signal corresponding to the plurality of pixels through the data line;

a power supply controller that controls a driving power source voltage supplied to the plurality of pixels and a reference voltage;

a compensation control signal unit that generates and transmits a first control signal and a second control signal to control the transistors included in each of the plurality of pixels depending on periods included in one frame; and a timing controller that processes an external image signal to generate and transmit an image data signal corresponding to a frame to the data driver, and controls a driving of the scan driver, the data driver, the power supply controller, and the compensation control signal unit.

15. The display device as claimed in claim 14, wherein the data driver transmits the second voltage or a data voltage of an image data signal corresponding to the plurality of pixels, and the compensation control signal unit generates and transmits a third control signal to allow the power supply controller to apply the reference voltage.

16. A display device, comprising:

a display panel, the display panel including a plurality of pixels that, during one frame, receive a first voltage transmitted through a power supply line and a second voltage through a data line, receive and store a third voltage of a first image data signal of a current frame, and emit light by driving current for a fourth voltage of a second image data signal of a previous frame, wherein, of one frame, a data writing period for storing the third voltage and a light emission period for emitting light by the driving current for the fourth voltage overlap each other, wherein each of the plurality of pixels includes:

an organic light emitting diode;

a first transistor to transmit the driving current to the organic light emitting diode;

a second transistor between the data line and a third contact point, the second transistor to transmit the second voltage and the third voltage of the first image data signal of the current frame to the third contact point through the data line in response to a corresponding one of a plurality of scan signals;

a fourth transistor between a fourth contact point and a fifth contact point, the fourth transistor to transmit the fourth voltage of the second image data signal of the previous frame to the fifth contact point;

a storage capacitor including electrodes connected between a source electrode of the first transistor and the fifth contact point; and a sustain capacitor including a first electrode connected to a third contact point and a second electrode connected to the fourth contact point, and wherein the second transistor and the fourth transistor are turned on during a data transmission period, during which the fourth voltage is transferred from the fourth contact point to the fifth contact point.

17. The display device as claimed in claim 16, wherein one frame includes:

a reset period for transmitting the first voltage to one end of a compensation capacitor connected to a gate electrode of the first transistor through the power supply line;

an initialization period for applying a first power source voltage of a first level from a power supply unit and setting a drain electrode voltage of the first transistor of the pixel to the first level;

a compensation period for simultaneously compensating for a threshold voltage of the driving transistor of each of the plurality of pixels;

data transmission period for transmitting a fourth voltage of a second image data signal corresponding to the previous frame to one end of the compensation capacitor, wherein:

the data writing period is for storing the third voltage of the first image data signal corresponding to the current frame in response to the plurality of scan signals sequentially transmitted to the plurality of pixels; and the light emission period is for allowing the organic light emitting diode of each of the plurality of pixels to simultaneously emit light by the driving current for the fourth voltage transmitted in the data transmission period, the light emission period overlapping the data writing period.

18. The display device as claimed in claim 17, wherein the data writing period is equal to or shorter than the light emission period.

19. The display device as claimed in claim 16, wherein each of the plurality of pixels includes:

a third transistor between a gate electrode and a drain electrode of the first transistor and diode-connects the gate electrode and the drain electrode of the first transistor;

a fifth transistor between the power supply line and the fourth contact point and transmits the first voltage applied through the power supply line to the fourth contact; and a compensation capacitor including electrodes connected between the gate electrode of the first transistor and the fifth contact point, respectively.

20. The display device as claimed in claim 19, wherein the sustain capacitor maintains a voltage value stored for the third voltage of the first image data signal until a data transmission period of a next frame, and maintains a voltage value stored for the second image data signal until a data transmission period of the current frame.

21. The display device as claimed in claim 19, wherein a first power source voltage applied to the source electrode of the first transistor is transmitted at a low level during an initialization period, a second power source voltage applied to the drain electrode of the first transistor is transmitted at a low level during the light emission period, the plurality of scan signals are simultaneously transmitted at a gate-on voltage level to gate electrodes of the second transistors of the plurality of pixels during the data transmission period, and sequentially transmitted at the gate-on voltage level to the gate electrodes of the second transistors of each pixel line during the data writing period, a first control signal transmitted to a gate electrode of the third transistor is transmitted at a gate-on voltage level during a compensation period, a second control signal transmitted to a gate electrode of the fourth transistor is transmitted at a gate-on voltage level during a reset period, the compensation period, and the data transmission period, and a third control signal transmitted to a gate electrode of the fifth transistor is transmitted at a gate-on voltage level during a remaining period other than the data transmission period.

22. The display device as claimed in claim 19, wherein the first voltage is applied through the power supply line during a reset period while the fifth transistor is in a turned-on state, and the second voltage is applied through the data line during a data transmission period in which the plurality of scan signals are simultaneously transmitted at a low level to turn on the second transistor.

23. A method for driving a display device that includes a display panel, the display panel including a plurality of pixels that receive a first voltage transmitted through a power supply line and a second voltage through a data line, receive and store a third voltage of a first image data signal of a current frame, and emit light by driving current for a fourth voltage of a second image data signal of a previous frame, wherein each of the plurality of pixels includes:

an organic light emitting diode;

a first transistor that transmits the driving current to the organic light emitting diode;

a second transistor between the data line and a third contact point and transmits the second voltage and the third voltage of the first image data signal of the current frame to the third contact point through the data line in response to a corresponding one of a plurality of scan signals;

a fourth transistor between a fourth contact point and a fifth contact point and transmits a voltage stored in response to the second image data signal corresponding to the previous frame to the fifth contact point;

a storage capacitor including electrodes connected between a source electrode of the first transistor and the fifth contact point, the storage capacitor to store a voltage difference between the fourth voltage corresponding to the second image data signal and the first voltage; and a sustain capacitor including a first electrode connected to a third contact point and a second electrode connected to the fourth contact point, the sustain capacitor to store a voltage difference between the fourth voltage of the second image data and the first voltage, the method comprising:

transmitting the first voltage to one end of a compensation capacitor connected to a gate electrode of the first transistor through the data line during a reset period;

applying a first power source voltage of a first level from a power supply unit and setting a drain electrode voltage of the first transistor to the first level during an initialization period;

simultaneously compensating for a threshold voltage of the first transistor of each of the plurality of pixels during a compensation period;

transmitting the fourth voltage to one end of the compensation capacitor during a data transmission period;

storing the third voltage in response to a plurality of scan signals sequentially transmitted to the plurality of pixels during a data writing period; and allowing the organic light emitting diode of each of the plurality of pixels to simultaneously emit light by the driving current for the fourth voltage transmitted in the data transmission period during a light emission period, the light emission period overlapping the data writing period, and wherein the second transistor and the fourth transistor are turned on during the data transmission period, during which the fourth voltage is transferred from the fourth contact point to the fifth contact point.

24. The method as claimed in claim 23, wherein the data writing period is equal to or shorter than the light emission period.

25. The method as claimed in claim 23, wherein the first voltage has a gate-on voltage level for turning on elements of each pixel.

26. The method as claimed in claim 23, wherein the second voltage is set to a voltage value between lowest and highest values of a data voltage of an image data signal.

27. The method as claimed in claim 23, wherein an amount of driving current is determined by taking into account an amount of voltage change according to a capacitance ratio of a storage element connected to one end of the compensation capacitor connected to the gate electrode of the first transistor, with respect to the fourth voltage.

28. The method as claimed in claim 23, wherein all of the pixels do not emit light during the reset period, the initialization period, the compensation period, and the data transmission period.

29. The method as claimed in claim 23, wherein the first image data signal is a first viewpoint image data signal or a second viewpoint image data signal corresponding to the current frame, the second image data signal is a first viewpoint image data signal or a second viewpoint image data signal corresponding to the previous frame, and viewpoints of the first image data signal and the second image data signal are different.

* * * * *